United States Patent [19]

Borenstein

[11] Patent Number: 4,971,126

[45] Date of Patent: Nov. 20, 1990

[54] COMBINATION GOLF CLUB COVER AND CLEANING TOOL

[75] Inventor: Charles Borenstein, Miami, Fla.

[73] Assignee: BSF Industries, Inc., Miami, Fla.

[21] Appl. No.: 303,309

[22] Filed: Jan. 27, 1989

[51] Int. Cl.[5] ..... A63B 57/00

[52] U.S. Cl. ..... 150/160; 206/315.4; 15/105

[58] Field of Search ..... 150/159, 160; 206/315.2–315.4; 273/32 B, 32 R; 15/21 A, 105, 111

[56] References Cited

U.S. PATENT DOCUMENTS

| | | | |
|---|---|---|---|
| 2,857,608 | 10/1958 | Schwartz | 15/111 |
| 2,925,840 | 2/1960 | Hird | 150/160 X |
| 2,981,964 | 5/1961 | Downing | 15/105 |
| 3,047,896 | 8/1962 | Gunderson | 15/105 X |
| 3,128,812 | 4/1964 | Scheurer | 150/160 X |
| 3,406,419 | 10/1968 | Young | 150/160 X |
| 3,478,799 | 11/1969 | Hoyt, Jr. | 150/160 |
| 3,638,284 | 2/1972 | Baker | 150/160 X |
| 3,831,652 | 8/1974 | Hyden et al. | 150/160 |
| 3,938,570 | 2/1976 | Stewart | 150/160 |
| 4,086,678 | 5/1978 | Torr | 15/105 |
| 4,164,969 | 8/1979 | Dien | 150/160 X |
| 4,498,579 | 2/1985 | Brick | 206/315.4 |

FOREIGN PATENT DOCUMENTS

| | | | |
|---|---|---|---|
| 261329 | 5/1965 | Australia | 206/315.2 |
| 12382 | of 1914 | United Kingdom | 206/315.2 |
| 365226 | 1/1932 | United Kingdom | 206/315.3 |
| 974912 | 11/1964 | United Kingdom | 150/160 |

*Primary Examiner*—Sue A. Weaver

*Attorney, Agent, or Firm*—Malin, Haley, McHale, DiMaggio & Crosby

[57] ABSTRACT

A golf club cover comprising a cover means, the cover means being of a semi-rigid, flexible plastic material, the golf club cover including an opening, the cover being designed to generally facilitate and correspond to the dimensions of a golf club. The invention includes a brush, the brush being integrally attached to the cover, the brush capable of cleansing foreign debris from the face of a golf club. A scraper is also being integrally attached to the golf club cover.

5 Claims, 1 Drawing Sheet

COMBINATION GOLF CLUB COVER AND CLEANING TOOL

BACKGROUND OF THE INVENTION

The subject matter of the invention relates to golf club covers and more particularly to a combination golf club cover which incorporates a brush and a scraper as integral parts of the cover.

Over the years golfers have developed a number of accessory products for use with golf clubs and golf bags. These include a variety of golf club covers, cleaning equipment, decorative items, and novelty items. For example, U.S. Pat. No. 3,478,799 discloses a basic golf club cover; U.S. Pat. No. 3,128,812 discloses a type of golf club coVer which is readily detachable from a golf bag; U.S. Pat. No. 625,862 discloses a decorative golf club cover with tassels; U.S. Pat. No. 3,831,652 discloses a cover and towel means; and U.S. Pat. No. 3,406,419 discloses a self-polishing golf club cover.

Although many of the above referenced patents relate to some form of a golf club cover, none of these inventions teach or suggest a combination golf club cover which integrally incorporates a brush means and scraper means for easy use in cleaning the golf clubs while the golfer is on the fairways or playing the game.

It is therefore highly desirable to provide a combination golf club cover which integrally includes a brush means and a scraper means.

It is also highly desirable to provide a combination golf club cover, brush means and scraper means which is cost effective yet operationally efficient.

It is also highly desirable to provide a combination golf club cover, brush means and scraper means which can be adapted for use with any given golf club.

It is also highly desirable to provide a combination golf club cover, brush means and scraper means which readily interfaces with the golf club itself, and eliminates the need for carrying an individual golf club brush as well as an individual golf club scraper as extraneous accessories within the golf bag.

It is finally highly desirable to provide a combination golf club cover, brush means and scraper means which incorporates all of the above mentioned features and objects.

SUMMARY OF THE INvENTION

It is therefore an object of the invention to provide a combination golf club cover which integrally includes a brush means and scraper means.

It is also an object of the invention to provide a combination golf club cover, brush means and scraper means which is cost effective yet operationally efficient.

It is also an object of the invention to provide a combination golf club cover, brush means and scraper means which can be adapted for use with any given golf club.

It is also an object of the invention to provide a combination golf club cover, brush means and scraper means which readily interfaces with the golf club itself, and eliminates the need for carrying an individual golf club brush as well as an individual golf club scraper as extraneous accessories within the golf bag.

It is finally an object of the invention to provide a combination golf club cover, brush means and scraper means which incorporates all of the above mentioned features and objects.

Briefly, what is provided is a combination golf club cover, brush means and scraper means. The brush means, in one embodiment, is comprised of hard bristles which are capable of easily and efficiently cleaning a golf club while the game is in play. Golfers, both accomplished and hackers, frequently soil the golf club face or head with dirt, mud, sand, grass, weeds or other impediments frequently found on the typical golf course. It then becomes necessary to cleanse the club face or head, which is accomplished with the instant brush means.

On a particular shot, it is possible for the club face to accumulate a substantial amount of dirt or mud, which is easily removed with the instant scraper means of the invention. After the extraneous matter is removed from the club face, the brush means can thereafter be used to further clean the club face such that it is ready for the next shot.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein.

DESCRIPTION OF THE PREFERRED EMBODIMENT

Figure 1:
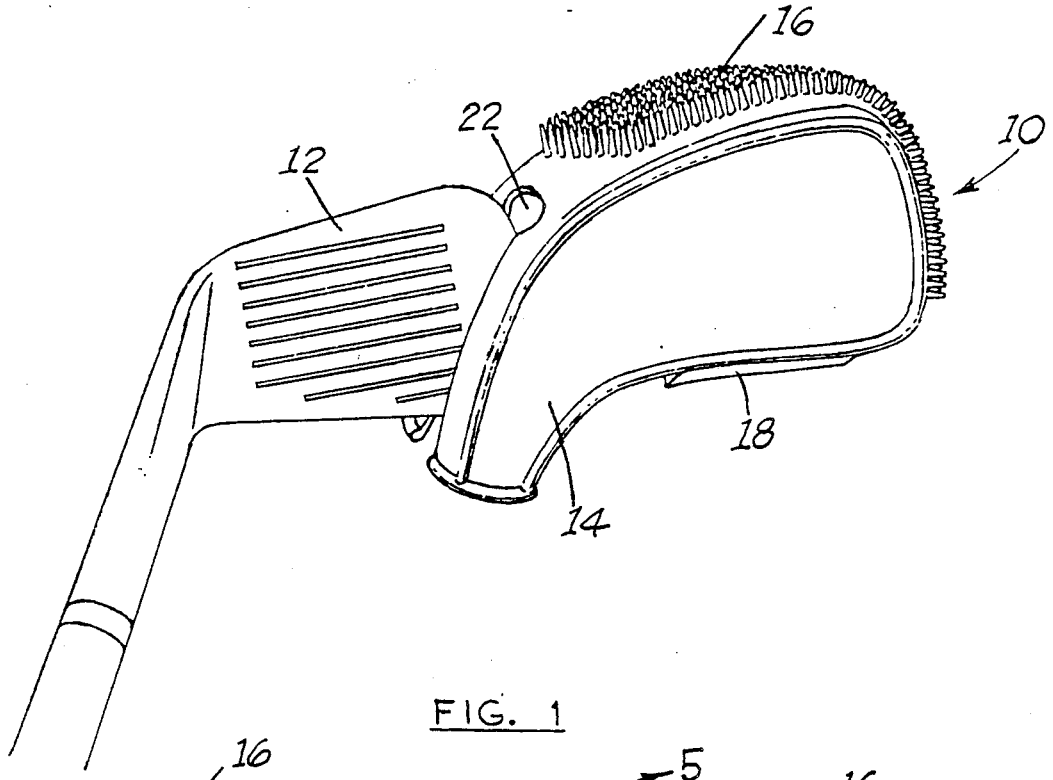
FIG. 1 is a perspective view of an embodiment of the invention being used in conjunction with a golf club.

Referring now to FIG. 1, the combination golf club cover, brush means and scraper means is generally shown at 10, for use with a typical golf club 12. The invention is comprised of golf club cover 14, brush means 16, and scraper means 18.

Figure 3:
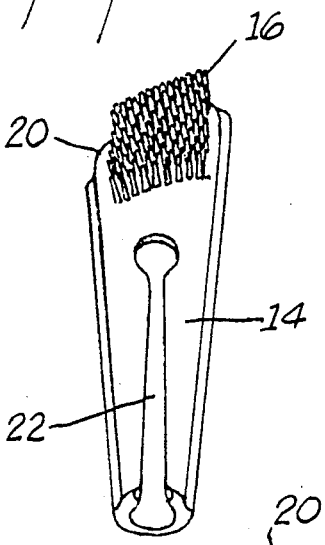
FIG. 3 is a rear plan view of the invention as illustrated in FIG. 2.
Figure 2:
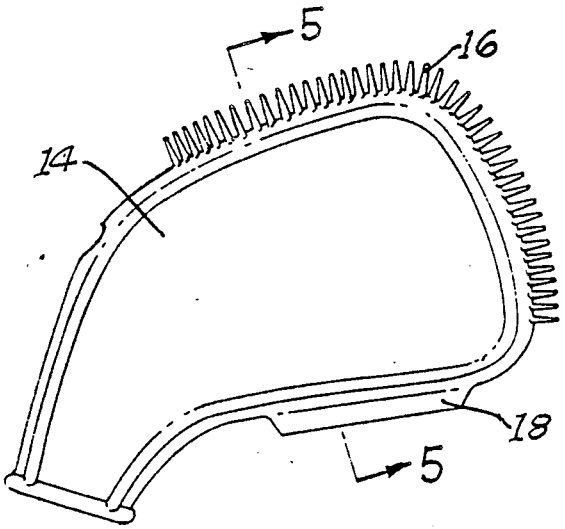
FIG. 2 is a side plan view of the instant invention.
Figure 4:
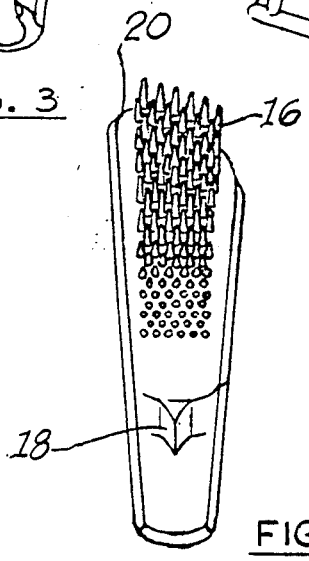
FIG. 4 is a front plan view of the invention as illustrated in FIG. 2.
Figure 5:
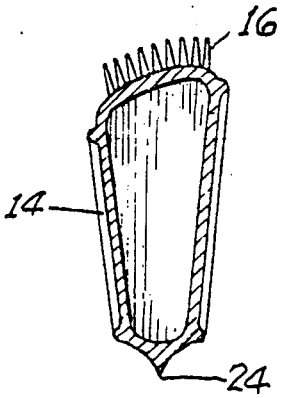
FIG. 5 is a cross sectional view of an embodiment of the invention as illustrated in FIG. 2.

Golf club cover 14 is designed and shaped to generally facilitate and accommodate the shape of the golf club 12. As shown in FIGS. 3, 4 and 5, the golf club cover 10 can have a pitch at 20 which generally corresponds to the pitch of a typical golf club, or iron, for example irons 2 through 9, the sand wedge and the pitching wedge. For purposes of the instant invention, the shape of the golf club cover is not critical, as long as it corresponds generally to the shape of the particular club desired.

Referring to FIG. 3, note the opening 22 which allows the golf club 12 to be inserted into the instant invention from the rear.

In a particular embodiment, the golf club cover 14 is made of a semi-rigid, flexible material such as plastic which can be easily placed over the golf club head, yet will remain firmly positioned until removal by the golfer. In this manner there is somewhat of a "tight" fit, such that the covers are not accidentally removed, or lost, during play. Referring to FIG. 3, opening 22, dimensioned to be readily opened and placed around the golf club head, yet once in place it prevents accidental removal.

It can be seen that scraper means 18 and brush means 16 are, in one embodiment, integrally formed with the golf club cover. Scraper means 18 can be of the same material, and comes to a sharpened edge at 24. Thus, scraper means 18 provides a sharp, yet rigid, knife-like edge which can be utilized to scrape, or clean, excessive dirt or mud from the face of the golf club. In this embodiment, scraper means 18 is conveniently located at the generally opposite extreme from brush means 16, about the golf club cover 14.

The instant invention accomplishes many functions for the golfer. The golf club cover itself operates in a conventional manner to protect the club face, and is easily removable during play. The brush means 16 provides the mechanism for efficiently and effectively cleaning the golf club on the golf course, and eliminates the necessity for a separate golf club brush to be purchased and carried within a golf bag. Most irons today have a plurality of parallel grooves running across the face of the iron which increases the contact and propulsion of the golf ball. With a proper golf swing, the iron will contact a portion of the golf course turf slightly behind the ball, and the club will create a divot in the turf. The sod or mud then becomes caked within the grooves of the iron, and this requires cleaning before the next shot, as is accomplished with the instant product. It also greatly eliminates the accidental loss of such accessory equipment. Finally the same is true with the scraper means 18, as it eliminates the necessity to carry a separate scraper.

It will be recognized by those of ordinary skill in the art, that the brush means 16 could be any of a variety of brush-like members, which includes rigid bristles, rubber bristles, synthetic or plastic bristles, etc.

While there have been described above the principles of this invention in conjunction with specific apparatus, it is to be clearly understood that this description is made only by way of example and not as a limitation to the scope of the invention.

What is claimed is:

1. A combination golf club cover and cleaning tool comprising:

a cover means, said cover means being of a semi-rigid, flexible material, and including an opening means, said cover means designed to generally facilitate, and correspond to the shape of a golf club; and brush means, said brush means being integrally attached to said cover means, said brush means being capable of cleansing foreign debris from the golf club head, and said brush means comprising a plurality of bristle means, said bristle means being rigidly flexible, said bristle means being positioned about a peripheral edge of said cover means;

whereby an improved golf club cover is provided to quickly and efficiently cleanse a golf club face during play.

2. A combination golf club cover and cleaning tool as claimed in claim 1, further comprising:

scraper means, said scraper means being integrally attached to said cover means, said scraper means being capable of removing an excess amount of foreign debris, such as mud or dirt, from the face of said golf club.

3. A combination golf club cover and cleaning tool as claimed in claim 1, wherein:

said cover means is of a semi-rigid, flexible plastic material.

4. The combination golf club cover and cleaning tool of claim 2, wherein said scraper means comprises a knife-like edge for efficiently scraping foreign material from said club face or head.

5. A combination golf club cover and cleaning tool, comprising:

a cover means, said cover means being of a semi-rigid, flexible plastic material, said cover means including an opening, said cover means being designed to generally facilitate, and correspond to the dimension and shape of a golf club;

a brush, said brush being integrally attached to said cover means, said brush being capable of cleansing foreign debris from the face of said golf club, said brush means being comprised of a plurality of bristle means, said bristle means being rigidly flexible, said bristle means being positioned about a peripheral edge of said cover means; and a scraper, said scraper being integrally attached to said cover means, said scraper being capable of removing an excess amount of foreign debris, such as mud or dirt, from the face of said golf club, said scraper having a rigid, knife-like edge, said scraper being positioned about said cover means at the opposite extreme from said brush.

* * * * *